United States Patent [19]

Panicci

[11] Patent Number: 4,485,963

[45] Date of Patent: Dec. 4, 1984

[54] CUP WITH PIVOTING STRAW

[75] Inventor: Richard L. Panicci, Hanover, Mass.

[73] Assignee: Kiddie Products, Inc., Avon, Mass.

[21] Appl. No.: 532,956

[22] Filed: Sep. 16, 1983

[51] Int. Cl.[3] ..... B65D 77/28

[52] U.S. Cl. ..... 229/7 S; 215/1 A; 215/229; 222/531; 222/536

[58] Field of Search ..... 229/7 S; 215/1 A, 229; 222/531, 536

[56] References Cited

U.S. PATENT DOCUMENTS 2,805,809 9/1957 Pugh ..... 229/7 S
3,240,415 3/1964 Pugh .
3,406,468 9/1966 Rogers .
3,730,737 5/1973 Harvey et al. ..... 229/7 S
3,840,153 10/1974 Devlin .
4,194,674 3/1980 Pearson .
4,226,356 10/1980 Lemelson .
4,282,991 8/1981 Hazard .
4,291,814 9/1981 Conn .
4,407,425 10/1983 Combs ..... 229/7 S

*Primary Examiner*—Joseph Man-Fu Moy

[57] ABSTRACT

A drinking cup and cover with a straw assembly seated in the cover; a fixed straw piece extends from the cover to the bottom of the cup and a movable straw piece of the assembly extends upwardly from a hole in the cup's cover and is pivotally and sealably attached thereto so as to permit pivoting of the straw with respect to the cover.

16 Claims, 8 Drawing Figures

FIG 1
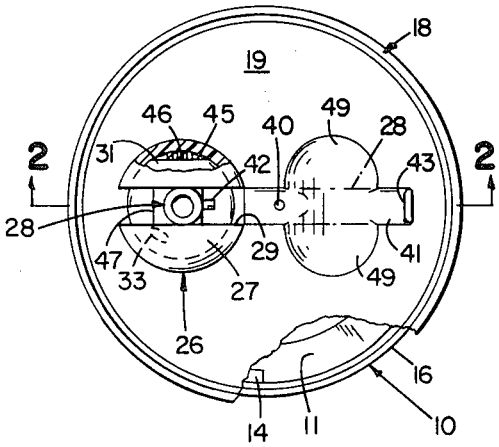
FIG 7
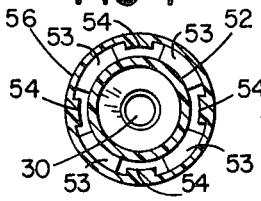
FIG 8
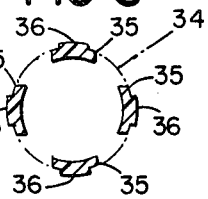
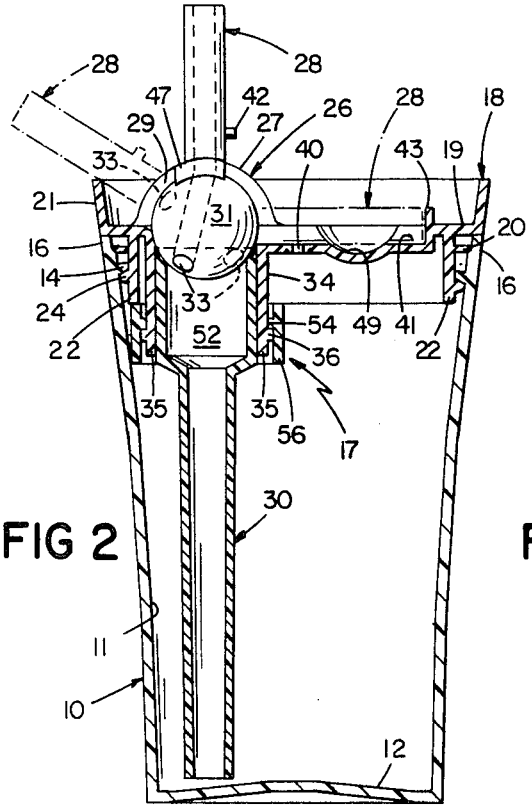
FIG 2
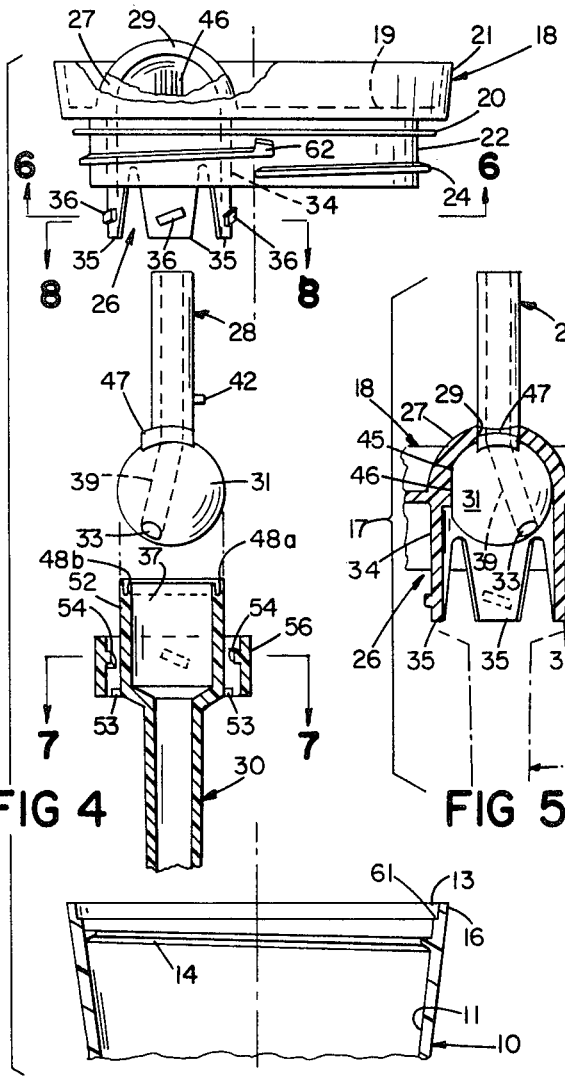
FIG 4
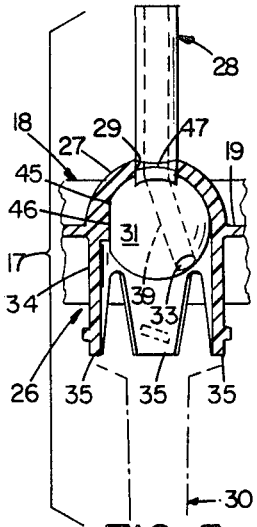
FIG 5
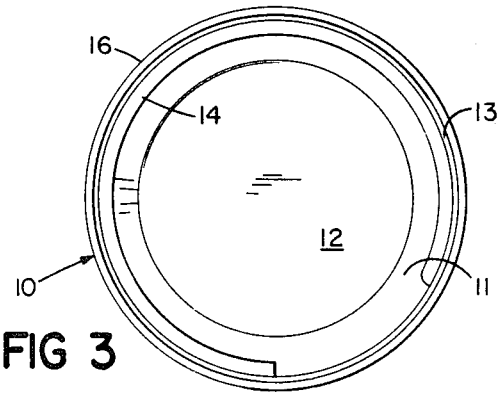
FIG 3
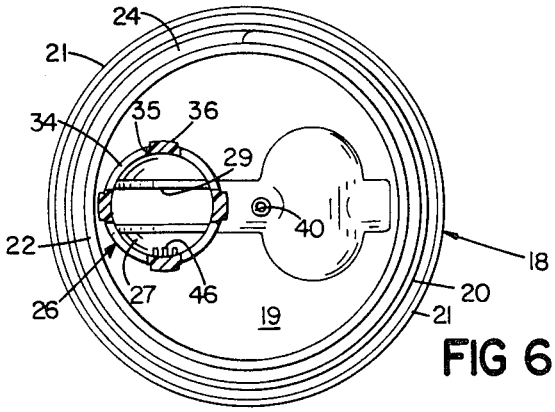
FIG 6

CUP WITH PIVOTING STRAW

BACKGROUND OF THE INVENTION

This invention relates to a covered drinking cup (e.g., for a child) which includes a straw assembly.

Drinking cups having straws molded into the wall of the cup are known in the art. One such cup is illustrated in U.S. Pat. No. 3,406,868. Also known in the art are beverage containers housing flexible straws which are accessible when the container is opened, as disclosed in U.S. Pat. Nos. 4,194,674 and 4,226,356 or when a second and separate lid is removed to expose the straw permanently mounted in the cover as in U.S. Pat. No. 3,240,415. The prior art also discloses closed beverage containers having two part straw assemblies in which the outer straw portion may be rotated in either a vertical or horizontal plane to open and close the fluid flow path through the straw, illustrated respectively in U.S. Pat. Nos. 3,890,153 and 4,291,814.

It is an object of the present invention to provide a permanent reusable straw assembly which is readily disassembled for cleaning and then reassembled. It is a further object of the invention to provide a straw assembly for a covered drinking cup in which the cover remains closed in use, and the external straw segment can be moved through a variety of operable positions without affecting the flow path through the straw for convenient angular access to the contents of the cup. It is a further object of the invention to provide a means for storing the external straw segment in a compact configuration that minimizes the opportunity for contamination of the straw or for spilling the contents of the cup particularly during transport of the cup from one location to another.

SUMMARY OF THE INVENTION

The invention features a straw assembly for a drinking cup, comprising a cover adapted to sealingly close the top of the cup and upper and lower tubular straw members; the cover has a straw connector for sealingly connecting the upper and lower straw members, which includes an upwardly extending rounded dome; a lower rounded segment of the upper straw member is contained within the dome and a hollow tubular straw member extends outwardly therefrom through a first opening in the dome; the inside of that tubular segment communicates through a passage within the rounded segment to a second external opening on the outer surface thereof; and the lower straw member is held, by co-operating fastening means on the lower straw and the connector, in a position that forces its upper terminal surface in slidable sealable contact with the rounded segment of the upper straw member, which surface includes a third opening in communication with the central passage of the lower straw member, and which (in at least one upper straw position) is also in communication with the second opening.

In preferred embodiments, the first opening through the dome is a vertical planar slot; and the upper straw may be stored in a cover recess that is coplanar with the dome slot and has a tab that covers the upper end of the upper straw; a rim extends around the periphery of the cover, and the dome is positioned off center, so that the dome slot is aligned with the shortest distance to the rim and, when the straw is pivoted in the dome slot toward the rim, the straw reaches and is stopped by the rim; when the upper straw is in the stored position, the second opening is adjacent the inner wall of the dome, and is thus protected against the introduction of foreign material; also when the upper straw is in the stored position, the contents of the cup are sealed from the second opening by a seal between the rounded segment of the upper straw member and the surface around the third opening; the lid includes an air intake means which is sealed when the upper straw is stored; the upper edge of the lower straw has a sealing means to cooperate with and seal to the outer surface of the rounded lower portion of the upper straw member as it pivots; the straw and connector fastening means are cooperatively configured threads; the lower straw member extends substantially to the bottom of the cup; and the lid comprises a deformable, horizontally disposed fin sized and configured to match a cooperating sealing surface of the cup, and the lid comprises a thread to sealingly mate with a cup thread, either of which threads may have a stop to prevent relative rotation beyond a fixed point.

DESCRIPTION OF THE PREFERRED EMBODIMENT

Drawings

FIG. 1 is a top view of the cup and straw assembly showing the straw in the vertical position and showing in broken lines the straw in the storage position;

FIG. 2 is a sectional view of the cup and straw assembly taken along 2—2 of the FIG. 1.

FIG. 3 is a top view of the cup with the straw assembly removed.

FIG. 4 is an exploded side view of the cup and straw assembly with parts broken away and in section.

FIG. 5 is a fragmentary side view of the cover and straw assembly, rotated 90° from the view illustrated in FIG. 3, with parts broken away and in section.

FIG. 6 is a bottom view of the cover, with parts broken away and in section, taken along 6—6 of FIG. 4.

FIG. 7 is a sectional view of the lower straw member taken along 7—7 of FIG. 4.

FIG. 8 is a sectional view of the cover connector and fastening means, taken along 8—8 of FIG. 4.

Structure

FIGS. 2 and 4 show a cup 10, straw assembly 17 (FIG. 5), and cover 18, each of which is formed from a sturdy plastic material. When all parts are assembled (FIG. 2), straw assembly 17 (FIG. 5) extends through connector segment 26 of cover 18, and comprises an upper straw segment 28 and a lower straw segment 30, which are joined at cover connector segment 26.

Cup 10 has a generally vertical outer wall 11 of gradually increasing diameter as it extends upward from a disc-shaped bottom 12 to the rim 16 of top cup opening 13. The top of the inside of cup wall 11 includes a sealing shoulder 61. A thread 14 (best shown in FIG. 3), around the circumference of the cup is provided on the inner surface of wall 11 spaced slightly below shoulder 11.

Cover 18 has a horizontal disc-shaped portion 19 and an upwardly extending circumferential outer lip 21. A cylindrical wall 22 extends vertically downwardly from the bottom of disc 19, from a region radially inward of lip 21; on its outer surface, wall 22 supports a horizontal annular sealing ring or fin 20 and a continuous thread 24 which is sized to cooperate with thread 14, and which includes a stop 62 at its end.

Straw connector 26 is a generally vertical, cylindrically shaped segment which is integral with and extends through the disc portion 19 of cover 18, off of the center of the disc and radially within sealing wall 22. Below portion 19 of cover 18, connector 26 comprises a vertical cylindrical portion 34. Below cylindrical portion 34, connector 26 is interrupted to provide four downwardly extending fingers 35 spaced apart from each other. Outwardly facing inclined thread segments 36 are provided on the external surfaces of fingers 35.

Connector 26 extends through disc 19 to form on the upper surface thereof a hollow hemispherical dome 27 having a slotted opening 29 therethrough sized and configured to allow the upper straw 28 to pivot therein along a vertical plane.

Straw assembly 17 has two separate straw pieces, upper straw 28 which extends through connector 26 and the top of disc 19, and lower straw 30 which is attached to the bottom of connector 26.

Upper straw 28 is generally tubular and terminates at its lower end in a spherical segment 31, whose outer diameter is sized to fit slidably within dome 27, so that upper straw 28 extends through slot 29 and pivots in a vertical plane. The inner passage of hollow straw member 26 extends through the spherical bottom segment 31 of the straw member to an external opening 33, through a passage 39 that is inclined at an obtuse angle to the upper tubular segment of member 26 and out of the plane of slot 29. A rectangular member 47 is around base of upper straw member 28, described below, to prevent rotation of the straw about its axis which (as described below) could misalign pin 42 and hole 40, as well as misaligning the openings 33 and 37 which allow communication between the upper and lower straws.

Cover 18 includes a storage recess 41 in the plane of slot 29, sized to accomodate the upper tubular portion of straw member 28. An air hole 40 in recess 41 allows air into the cup to equalize the pressure inside and outside the cup and thus enhance the pressure differential during use of the straw. When segment 28 is pivoted into recess 41, pin 42 on straw member 28 plugs hole 40 to prevent spilling and contamination of the cup's contents. Pin 42 is sized to be force-fitted into air hole 40, and air hole 40 tapers very slightly inwardly to hold pin 42, thus sealing hole 40. Tab 43 at the end of recess 41 is positioned to cover the upper end of straw segment 26 to avoid contamination of the straw. Gripping recesses 49 on either side of storage recess 41 allow access to the sides and bottom of straw member 28 to pull pin 42 from hole 40 and thus easily remove straw member 28 from recess 41.

Spherical segment 31 has a flat face 45, shown in FIGS. 5 and 6, which co-operates with a series of vertical ridges 46 inside dome 27, shown in FIGS. 4 and 6, to act as a guide during assembly of straw member 28 in dome 27 to orient it in slot 29 with pin 42 facing air hole 40. Rectangular member 47 fits longitudinally within slot 29 to prevent the user from twisting upper straw member 28, thus misaligning pin 42 and hole 40. When upper straw member 28 is rotated fully away from the storage recess, (broken line of FIG. 2), straw member 28 is stopped against lip 21.

Lower straw 30 comprises a vertical tube extending, when assembled, to adjacent the cup bottom 12. Lower straw 30, at its upper end, also comprises an enlarged coaxial cylindrical segment 52 sized to sealingly fit within the inner diameter of cylindrical portion 34 of connector 26 and within fingers 35 . Segment 52 is surrounded by an annular collar 56 which is connected to the segment 52 at its lower end by web members 53, spaced apart to permit liquid to flow therepast. The inner vertical surface of collar 56 has four thread segments 54 equally spaced around its circumference above web members 53 to cooperate with and screw onto threads 36 of connector segment 26.

The upper edge 48 of segment 52 defines an opening 37 which cooperates with the outer surface of spherical segment 31 as upper straw 28 pivots. The seal between the upper and lower straws is provided by the upper edge surface 48 of segment 52 around opening 37 on the one hand, and the outer surface of spherical segment 31 on the other hand. Specifically, surface 48 includes inner and outer annular upward projections **48*a* and 48*b* respectively. As the cup is assembled, spherical segment 31 is forced against inner projection 48*b*, deforming that projection slightly outwardly to form a low-area circumferential seal with the outer surface of segment 31. Deformation of in projection 48*b* is stopped by projection 48*b***.

Alternatively, surface 48 can be a conical surface to provide a low-area sealing contact with segment 31. With lower straw 30 mounted on connector 26, web members 53 are positioned below fingers 35 and edge 48 abuts rounded segment 31.

As shown in FIGS. 2 and 5, passage 39 in segment 31 is disposed at an obtuse angle to the passage in the upper tubular segment of member 28. Specifically, when the upper tubular segment of member 28 is stopped against rim 21 (see broken line of FIG. 2), opening 33 remains in communication with the upper opening 37 of lower straw member 30; as the upper tubular segment is rotated in the plane of slot 29 past vertical to a storage position (see broken line of FIG. 1), opening 33 rotates across opening 37. When the upper tubular segment 28 is in a stored position, opening 33 is rotated out of communication with opening 37. Moreover, opening 33 is intentionally located out of the plane of slot 29, so that, in the storage position, opening 33 is adjacent the inner surface of dome 27, and is thereby protected from foreign material.

The four parts of the cup are readily molded from plastic according to techniques known in the art.

Assembly

The cup, cover and straw are easily assembled by inserting upper straw 28 through opening 29 in cover 18 and then screwing collar 56 of lower straw 30 onto connector segment 26 of cover 18. The cover is then screwed onto the cup.

Sealing ring 20 is sized and configured to seal against shoulder 61 on the inner wall of the cup. Ring 20 is deformable (about 0.10 inch) so that when threads 24 and 14 are engaged by rotation, ring 20 meets shoulder 61 before the thread rotation is stopped by stop 62. Stop 62 is placed so that designs on the cup and lip will be properly aligned when the stop is reached. Deformable sealing ring 20 ensures a seal against the cup regardless of the relative rotational positions of the cup and lid when their cooperating threads are engaged.

Use

In use, the straw is free to pivot in the plane of slot 29 to aid drinking from various positions. The cup cannot readily be disassembled by an infant, but is easily disassembled into its four constituent parts for complete cleaning. The various sealing provisions discussed limit spilling if the cup is inverted, and avoid contamination. The storage position of the upper straw permits transporting the cup, filled with liquid, without danger of spilling.

The two parts of straw 17 are sufficiently aligned and sealed by connector 26 so that they form a continuous liquid flow path from the top of the straw to the bottom of the cup, and suction can be transmitted along that flow path.

Other Embodiments

Other embodiments are within the following claims. For example, the cover may be interference fitted to the top of the cup without a threaded connection. Also, the domed opening need not be a slot, but may be an oversized (relative to the tubular segment of the upper straw member) opening to allow pivoting of the straw in multiple directions or planes.

What is claimed is:

1. A straw assembly for a drinking cup, said assembly comprising a cup cover adapted to sealingly close the top of a cup, and upper and lower tubular straw members, said assembly characterized in that:

said cover comprises a connector for sealingly connecting said upper and lower straw members, and said connector comprises a hollow, upwardly protruding, rounded dome having a first opening therethrough, and said connector further comprises a fastening means for connecting said lower straw member to said cover, said upper straw member comprises a lower rounded segment contained within said dome and a hollow tubular segment extending outwardly from said rounded segment through said dome opening, said tubular segment being movable in said first opening through a number of positions, the inner passage defined by said hollow tubular segment communicating through a passage means within said rounded upper straw segment to a second opening on the outer surface of said rounded straw segment, said lower straw member comprises an upper terminal surface configured to slidably and sealably engage said rounded segment of said upper straw member, said lower straw member further comprises fastening means cooperating with said connector fastening means for removably securing said straw members to said connector in a position that forces said terminal surface of said lower straw member in slidable, sealable contact with said rounded segment of said upper straw member, and said upper terminal surface of said lower straw member comprises a third opening, in communication with the central passage of said lower straw member and in communication with said second opening in at least one of said positions of said tubular segment, whereby said upper and lower straw member are maintained in slidable sealable contact as said tubular segment moves in said first opening.

2. The straw assembly of claim 1 wherein said first opening is a slot through said dome, which permits pivoting of said upper straw segment in a vertical plane.

3. The straw assembly of claim 2 wherein said upper straw tubular segment is movable in said slot from a storage position to a series of operable positions.

4. The straw assembly of claim 3 wherein said second opening is adjacent the inner surface of said dome when said upper straw segment is in said stored position, to prevent introduction of foreign material into said second opening.

5. The assembly of claim 4 wherein, in said storage position, said second opening is sealed from the contents of said cup by the seal between said upper terminal surface of said lower straw member and the rounded segment of said upper straw member.

6. The assembly of claim 4 wherein said cover comprises a vent means to equalize pressure inside and outside said cup, and said straw includes a sealing means to seal said vent when said straw is being stored.

7. The straw assembly of claim 3, 4, or 5 wherein said cover defines a storage recess for said tubular segment of said upper straw means, said recess being coplanar with said dome slot, whereby said upper straw segment may be pivoted in said dome slot from an operative position to a stored position within said recess.

8. The straw assembly of claim 7 wherein said recess includes a sealing tab positioned to cover the upper end of said upper straw member when said upper straw member is stored in said recess.

9. The straw assembly of claim 1 further characterized in that the said upper terminal surface of said lower straw member cooperates with and seals with the outer surface of said rounded lower portion of said upper straw member as said upper straw member pivots.

10. The straw assembly of claim 1 further characterized in that said straw and connector fastening means comprise cooperatively configured threads on said straw connector and said upper portion of said lower straw member, respectively.

11. The straw assembly claimed in claim 10 further characterized in that said threads of said straw fastening means are on an annular collar connected to and spaced outwardly of the upper portion of said lower straw member.

12. The straw assembly of claim 11 further characterized in that said cover comprises a downwardly extending cylindrical member having threads on its outer surface, said lower straw member comprises an annular collar which is sized to seal around said cover cylindrical member, extending from the perimeter of said lower straw member toward the upper end thereof, and said collar comprises threads on its inward vertical surface configured to cooperate with said cover threads.

13. A drinking cup assembly comprising the straw assembly of claim 1 and a cup sealed thereto.

14. The assembly of claim 13 further characterized in that, said lower straw member extends substantially to the bottom of the cup.

15. The assembly of claim 13 wherein said lid comprises a deformable, horizontally disposed fin sized and configured to match a cooperating sealing surface of said cup.

16. The assembly of claim 15 wherein said lid comprises a thread to sealingly mate with a cup thread, one of said threads comprising a stop to prevent relative rotation beyond a fixed point.

* * * * *